US011067081B2

(12) United States Patent
Hirata et al.

(10) Patent No.: US 11,067,081 B2
(45) Date of Patent: Jul. 20, 2021

(54) SCREW COMPRESSOR

(71) Applicant: Kobe Steel, Ltd., Hyogo (JP)

(72) Inventors: Kazuya Hirata, Hyogo (JP); Koji Hagihara, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 257 days.

(21) Appl. No.: 16/060,071

(22) PCT Filed: Nov. 29, 2016

(86) PCT No.: PCT/JP2016/085375
§ 371 (c)(1),
(2) Date: Jun. 7, 2018

(87) PCT Pub. No.: WO2017/110386
PCT Pub. Date: Jun. 29, 2017

(65) Prior Publication Data

US 2018/0347569 A1 Dec. 6, 2018

(30) Foreign Application Priority Data

Dec. 22, 2015 (JP) ..... JP2015-250174

(51) Int. Cl.
*F04C 18/16* (2006.01)
*F04C 29/06* (2006.01)
(Continued)

(52) U.S. Cl.
CPC ..... *F04C 18/16* (2013.01); *F04C 23/00* (2013.01); *F04C 29/005* (2013.01); *F04C 29/04* (2013.01);
(Continued)

(58) Field of Classification Search
CPC ..... F04C 18/02; F04C 18/16; F04C 23/00; F04C 23/001; F04C 29/005; F04C 29/063; F04C 29/04; F04C 29/12
(Continued)

(56) References Cited

U.S. PATENT DOCUMENTS 3,001,692 A * 9/1961 Schierl ..... F04D 25/163 415/66
3,355,096 A * 11/1967 Hornschuch ..... F04D 29/624 415/179
(Continued)

FOREIGN PATENT DOCUMENTS

CN 203394764 U 1/2014
JP H09-264253 A 10/1997
(Continued)

OTHER PUBLICATIONS

The extended European search report issued by the European Patent Office dated May 31, 2019, which corresponds to European Patent Application No. 16878280.3-1004 and is related to U.S. Appl. No. 16/060,071.
(Continued)

*Primary Examiner* — Charles G Freay
(74) *Attorney, Agent, or Firm* — Studebaker & Brackett PC

(57) ABSTRACT

A screw compressor includes: a screw compressor main body; a motor for driving the screw compressor main body; a gearbox interposed between the screw compressor main body and the motor to transmit a driving force of the motor to the screw compressor main body; and a gas cooler positioned below either the screw compressor main body or the motor and attached as a separate body to a side surface of the gearbox.

12 Claims, 3 Drawing Sheets

(51) Int. Cl.
*F04C 23/00* (2006.01)
*F04C 29/04* (2006.01)
*F04C 29/00* (2006.01)
*F04C 29/12* (2006.01)

(52) U.S. Cl.
CPC ..... *F04C 29/063* (2013.01); *F04C 23/001* (2013.01); *F04C 29/12* (2013.01)

(58) Field of Classification Search
USPC ..... 417/363, 243
See application file for complete search history.

(56) References Cited

U.S. PATENT DOCUMENTS 3,476,485 A * 11/1969 Kunderman ..... F04D 29/5826 415/66
3,644,054 A * 2/1972 Pilarczyk ..... F04D 29/582 415/179
3,912,000 A * 10/1975 Nyeste ..... F04D 25/02 165/47
4,010,016 A * 3/1977 Haugen ..... F04D 25/163 55/473
6,336,794 B1 * 1/2002 Kim ..... F04B 39/0044 417/363
6,991,440 B2 * 1/2006 Achtelik ..... F04C 18/16 418/201.1
8,313,312 B2 * 11/2012 Fujimoto ..... F04B 39/0033 417/321
8,499,892 B2 * 8/2013 Cavarello ..... F16K 11/076 184/6
2002/0001531 A1 * 1/2002 Takahashi ..... F04C 29/005 418/9
2002/0081213 A1 6/2002 Takahashi et al.
2003/0021701 A1 * 1/2003 Kolodziej ..... F04D 29/5826 417/243
2007/0077162 A1 4/2007 Tanaka et al.
2013/0136643 A1 5/2013 Yabe et al.
2017/0074266 A1 3/2017 Fukushima et al.

FOREIGN PATENT DOCUMENTS

JP 2000-161271 A 6/2000
JP 2002-021759 A 1/2002
JP 2007-332826 A 12/2007
JP 2008-133746 A 6/2008
JP 2015-169180 A 9/2015
KR 20-0148295 Y1 6/1999
WO 2012108868 A1 8/2012
WO WO 2012/108868 * 8/2012 ..... F04C 13/04

OTHER PUBLICATIONS

International Preliminary Report on Patentability issued in corresponding International Application No. PCT/JP2016/085375; dated Jul. 5, 2018.
International Search Report issued in PCT/JP2016/085375; dated Feb. 28, 2017.

* cited by examiner

SCREW COMPRESSOR

CROSS-REFERENCE TO RELATED APPLICATIONS

This is a national phase application in the United States of International Patent application No. PCT/JP2016/085375 with an international filing date of Nov. 29, 2016, which claims priority of Japanese Patent Application No. 2015-250174 filed on Dec. 22, 2015. The contents of this application are incorporated herein by reference.

TECHNICAL FIELD

The present invention relates to a screw compressor, and more particularly to an arrangement structure of a gas cooler in a screw compressor.

BACKGROUND ART

The screw compressor is provided with a gas cooler for cooling gas which has high temperature and high pressure by compression.

JP 2002-21759 A discloses a compact screw compressor in which a cooler casing and a step-up gear casing are integrally made of a cast material, and a compressor and an electric motor are mounted on the step-up gear casing part of the integrated casings.

PRIOR ART DOCUMENT

Patent Document

Patent Document 1: JP 2002-21759 A

DISCLOSURE OF THE INVENTION

Problems to be Solved by the Invention

The screw compressor mentioned in Patent Document 1 has a casing structure in which the cooler casing part, the step-up gear casing part, and the like are integrally formed of the cast material. Because of this, if any trouble occurs in the cooler casing part, work of removing and replacing the entire integrated casing structure will be required, which is a significant burden.

The cooler casing part is regarded as a pressure vessel and needs to be compliant with laws and regulations of each country. Further, the step-up gear casing part integrally formed with the cooler casing part can also be regarded as a pressure vessel, and thus inevitably has the same properties as the pressure vessel. Such a step-up gear casing part is of undue quality, which is more than needed in terms of structure and material. Consequently, the manufacturing cost of the step-up gear casing part increases, which leads to an increase in the manufacturing cost of the screw compressor as well.

Therefore, in view of these technical problems to be solved by the present invention, it is an object of the present invention to provide a screw compressor which can easily detach a gas cooler from a step-up gear without compromising compactness and can be manufactured at low cost.

Means for Solving the Problems

To solve the above-mentioned technical problems, the present invention provides the following screw compressor.

That is, a screw compressor is characterized by including:

a screw compressor main body;

a motor for driving the screw compressor main body;

a gearbox interposed between the screw compressor main body and the motor to transmit a driving force of the motor to the screw compressor main body; and a gas cooler positioned below either the screw compressor main body or the motor and attached as a separate body to a side surface of the gearbox.

Effects of the Invention

With the above-mentioned configuration, the gas cooler is positioned below either the screw compressor main body or the motor and attached as a separate body to a side surface of the gearbox, thereby making it possible to easily remove the gas cooler, though the screw compressor is compact. As the gearbox separately provided from the gas cooler is not regarded as a pressure vessel, the gearbox can adopt the optimal structure and material required therefor, and the screw compressor can be manufactured at low cost.

EMBODIMENTS OF THE INVENTION

Figure 2:
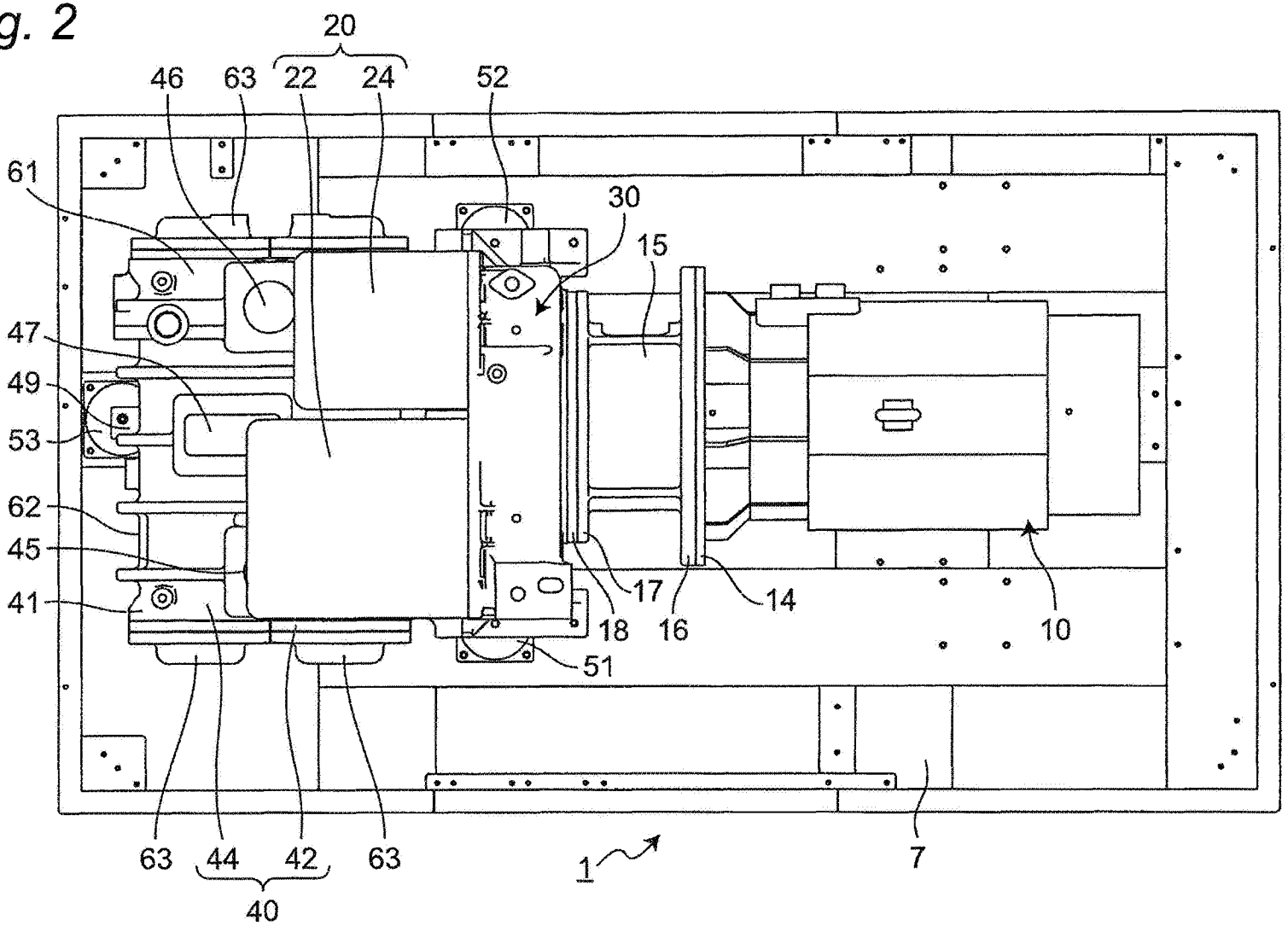
FIG. 2 is a plan view of the screw compressor shown in FIG. 1.
Figure 3:
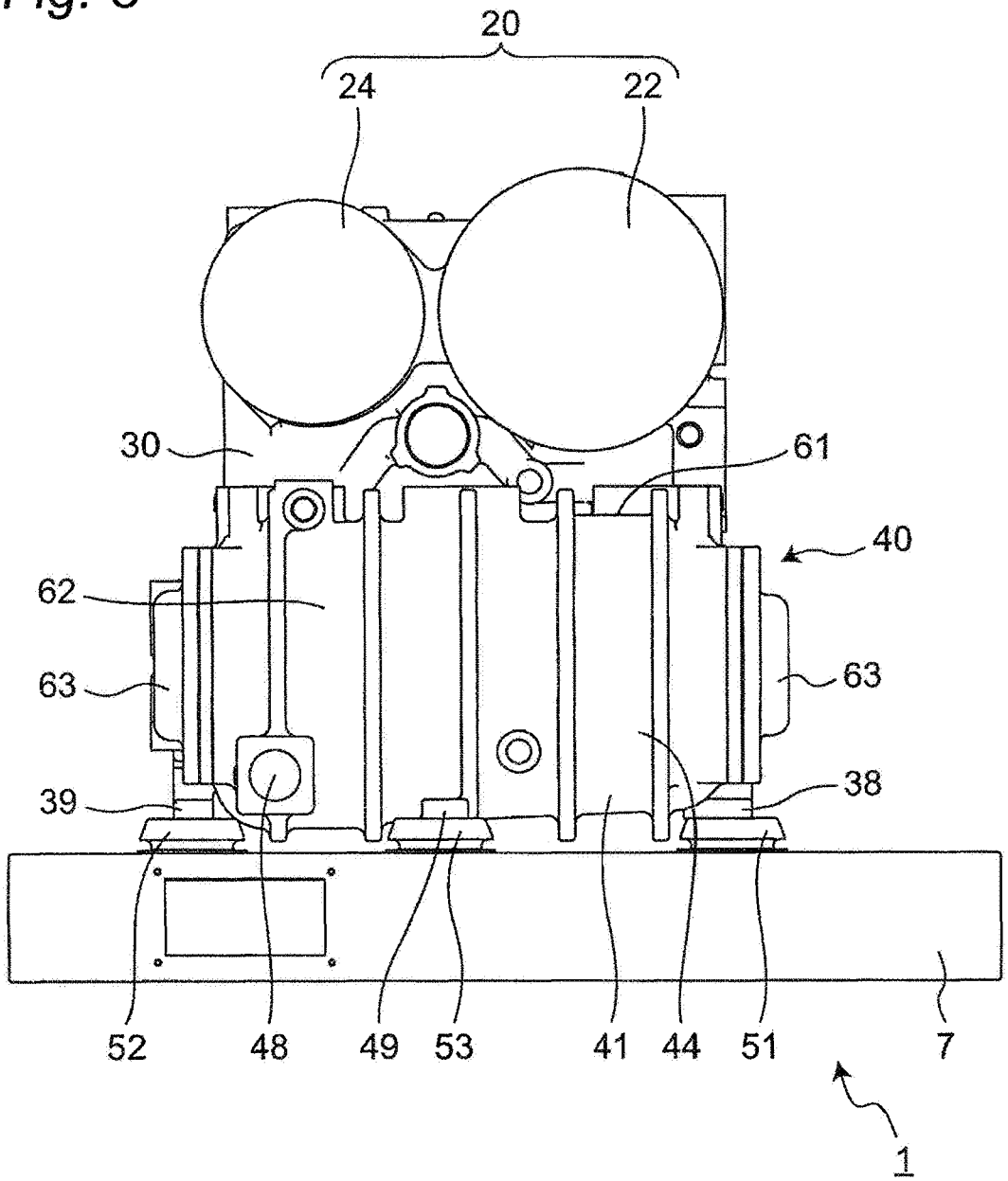
FIG. 3 is a side view of the screw compressor shown in FIG. 1.

A screw compressor 1 according to an embodiment of the present invention will be described with reference to FIGS. 1 to 3.

Figure 1:
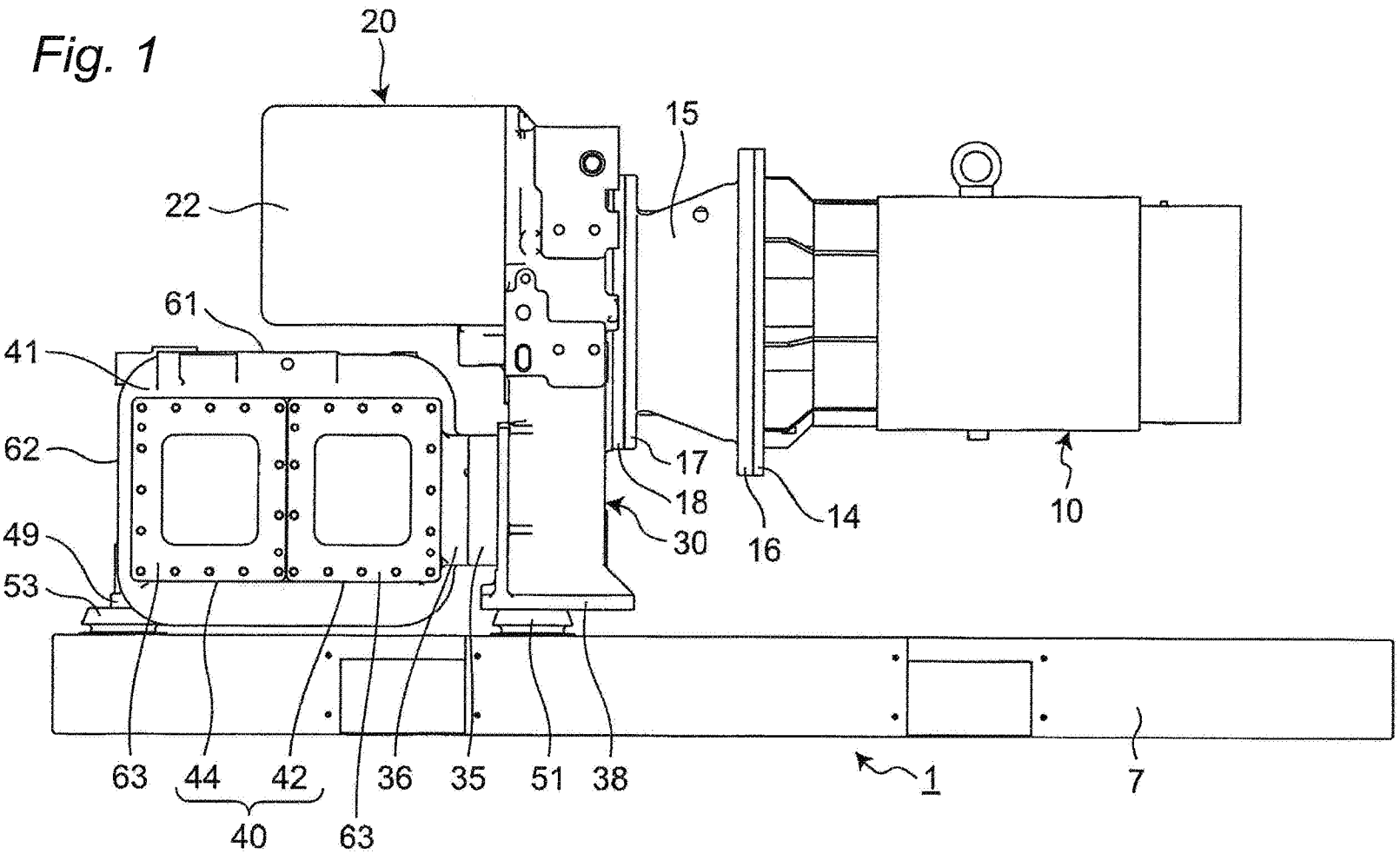
FIG. 1 is a front view of a screw compressor according to an embodiment of the present invention.

FIG. 1 is a front view of the screw compressor 1 according to an embodiment of the present invention; FIG. 2 is a plan view of the screw compressor; and FIG. 3 is a side view of the screw compressor. The screw compressor 1 shown in FIGS. 1 to 3 includes a motor 10, a screw compressor main body 20, a gearbox 30, a gas cooler 40, and a base plate 7.

The screw compressor main body 20 is a two-stage screw compressor that has a first stage compressor main body 22 on a low pressure side and a second stage compressor main body 24 on a high pressure side. The first stage compressor main body 22 is disposed on one side surface of the gearbox 30. The second stage compressor main body 24 is disposed on one side surface of the gearbox 30, which is the same side as the first stage compressor main body 22. The screw compressor main body 20 is connected to one side surface of the gearbox 30 in a state of being positioned at a predetermined location.

The first stage compressor main body 22 has a pair of male and female screw rotors that rotate while meshing with each other. The second stage compressor main body 24 has a pair of male and female screw rotors that rotate while meshing with each other. The respective screw rotors of the first stage compressor main body 22 and the second stage compressor main body 24 compress a fluid, such as gas.

The motor 10 that supplies a driving force to the first stage compressor main body 22 and the second stage compressor main body 24 is disposed on the other side surface of the gearbox 30. In other words, the gearbox 30 is interposed between the screw compressor main body 20 and the motor 10. The gearbox 30 is coupled to the first stage compressor main body 22 and the second stage compressor main body 24. The motor 10 is connected to the other side surface of the gearbox 30 via a substantially cylindrical connection casing 15 in a state of being positioned at a predetermined location. That is, a connection flange 16 of the connection casing 15 is connected to a motor-side connection flange 14 of the motor 10, while a coupling flange 17 of the connection casing 15 is connected to a coupling end 18 of the gearbox 30.

The gearbox 30 has a substantially rectangular parallelepiped shape that has a long side orthogonal to a motor shaft of the motor 10 or a rotor shaft (hereinafter sometimes simply referred to as a shaft) of the screw compressor main body 20, a short side extending in parallel to the shaft, and a height orthogonal to the shaft. A gear mechanism (any element therein not shown) is accommodated inside the gearbox 30. In the present embodiment, a bull gear, a first pinion gear, and a second pinion gear are accommodated as the gear mechanism. A coupling is accommodated inside the connection casing 15.

The motor shift of the motor 10 is coupled to an input shaft of the gear mechanism via the coupling. The bull gear is attached to the side of the input shaft opposite to the coupling side. The input shaft inputs the driving force of the motor 10 to the gearbox 30. The gear mechanism of the gearbox 30 transmits the driving force of the motor 10 to each of the screw rotors of the first stage compressor main body 22 and the second stage compressor main body 24.

One rotor shaft of the first stage compressor main body 22 extends within the gearbox 30, and the first pinion gear that meshes with the bull gear is attached to a shaft end part of the rotor shaft. One rotor shaft of the second stage compressor main body 24 extends into the gearbox 30, and the second pinion gear that meshes with the bull gear is attached to a shaft end part of the rotor shaft.

The bull gear connected to the input shaft, which is coupled to the motor shaft via the coupling, meshes with the first pinion gear of the first stage compressor main body 22 and the second pinion gear of the second stage compressor main body 24. Therefore, once the motor 10 is activated, the driving force of the motor 10 is input to the input shaft, transmitted from the bull gear to the first pinion gear and the second pinion gear, and then transmitted to the respective rotor shafts of the first stage compressor main body 22 and the second stage compressor main body 24. Then, the respective screw rotors of the first stage compressor main body 22 and the second stage compressor main body 24 rotate to compress the fluid such as gas.

The gas cooler 40 configured separately from the gearbox 30 is disposed on one side surface of the gearbox 30 where the screw compressor main body 20 is disposed. An attachment portion 36 of the gas cooler 40 is connected to an attachment portion 35 provided on one side surface of the gearbox 30 in a state of being positioned at a predetermined location. Thus, the gas cooler 40 is detachably attached to the gearbox 30 in a position lower than the screw compressor main body 20. The screw compressor main body 20 on the upper side is connected to the gas cooler 40 on the lower side by piping (not shown). The screw compressor main body 20 and the gas cooler 40 are positioned with respect to the gearbox 30 by using positioning pins so that the gas cooler 40 is arranged below the screw compressor main body 20, which facilitates handling of the piping for connecting both the screw compressor main body 20 and the gas cooler 40 and shortens the length of the piping.

The gas cooler 40 is a pressure vessel provided for cooling compressed gas discharged from the screw compressor main body 20. The gas cooler 40 includes an intercooler (first gas cooler) 42 and an aftercooler (second gas cooler) 44, which are integrally formed in a substantially rectangular parallelepiped shape. The intercooler 42 is provided in a gas path between the first stage compressor main body 22 and the second stage compressor main body 24, and the aftercooler 44 is provided in a gas path disposed downstream of the second stage compressor main body 24. The gas cooler 40 may have a substantially rectangular parallelepiped shape that has a long side orthogonal to the shaft, a short side extending in parallel to the shaft, and a height orthogonal to the shaft in order to effectively utilize an installation space.

The intercooler 42 is a cooler for lowering the temperature of the compressed gas that has its temperature increased by being compressed in the first stage compressor main body 22. The aftercooler 44 is a cooler for lowering the temperature of the compressed gas that has its temperature increased by being compressed in the second stage compressor main body 24. The gas cooler 40 is, for example, a shell and tube type water-cooled heat exchanger.

Within a heat exchange portion through which the compressed gas circulates, a plurality of straight heat exchange pipes is installed side by side. Cooling water (cooling medium) is caused to flow through the inside of the heat exchange pipes. The compressed gas to be cooled circulates around the heat exchange pipes. It is noted that a part where the plurality of heat exchange pipes is installed is called a tube nest portion. The heat exchange pipes are arranged in parallel to each other. Further, it is noted that piping and the like for inflow or outflow of the cooling water is not illustrated.

A top wall portion 61 of a cooler casing 41 is respectively provided with an inter-inlet port 45 connected to the discharge side of the first stage compressor main body 22, an inter-outlet port 46 connected to the suction side of the second stage compressor main body 24, and an after-inlet port 47 connected to the discharge side of the second stage compressor main body 24. An after-outlet port 48 is provided at the lower side of a sidewall portion 62 located on the side of an aftercooler 44 of the cooler casing 41. Covers 63 are respectively attached to both side ends of the cooler casing 41 to maintain liquid tightness. The tube nest portion is detachable from the cooler casing 41 and thus can be easily replaced by removing the cover 63 in the event of trouble.

The compression gas supplied to the first stage compressor main body 22 is compressed by the first stage compressor main body 22, sent from the discharge port on the bottom surface side thereof to the inter-inlet port 45 on the upper surface side of the intercooler 42, cooled by the intercooler 42, and then discharged from the inter-outlet port 46 on the upper surface side of the intercooler 42. Thereafter, the compressed gas is supplied to the second stage compressor main body 24 and further compressed by the second stage compressor main body 24. Subsequently, the compressed gas is sent from the discharge port on the bottom surface side of the second stage compressor main body 24 to the after-inlet port 47 on the upper surface side of the aftercooler 44, cooled by the aftercooler 44, and then discharged from the after-outlet port 48. It should be noted that since the screw compressor main body 20 and the gas cooler 40 are connected together in a state of being positioned with respect to the gearbox 30, the length of the piping connecting both of them is mechanically determined. Thus, there is no need to provide an error buffering member, such as an expansion pipe joint for buffering an error in the pipe installation length, at some midpoint of the piping. Further, the length of the piping becomes as short as possible by arranging a discharge port on the bottom surface side of the screw compressor main body 20 and arranging an introduction port on the top surface side of the gas cooler 40.

A support end portion 49 is provided at a position below the cooler casing 41 and away from the gearbox 30. For example, as shown in FIG. 2, the support end portion 49 is arranged at one site located farthest away from the gearbox 30 and substantially at the center of the long side of the cooler casing 41 as shown in FIG. 3. Avibration isolator 53 is interposed between the lower surface of the support end portion 49 and the upper surface of the base plate 7. The vibration isolator 53 is arranged not at one end and the other end of the long side of the cooler casing 41, but substantially at the center of the long side. A connection port for introducing or guiding out the compressed gas, such as the after-outlet port 48, any cooling-water piping, and the like are provided on the side of an end of the long side of the cooler casing 41 shown in FIG. 3 in many cases. Such provision needs consideration not to interrupt a replacement work of the tube nest portion in the gas cooler 40. For this reason, the vibration isolator 53 is preferably provided substantially at the center in the long-side direction (direction orthogonal to the shaft) of the cooler casing 41 rather than on the side of the end of the long side of the cooler casing 41. Therefore, the arrangement of the vibration isolator 53 substantially at the center of the long side of the cooler casing 41 improves flexibility in the configuration of the heat exchange portion in the gas cooler 40, which facilitates the replacement work of the tube nest portion in the gas cooler 40.

Support end portions 38 and 39 are provided under the gearbox 30. For example, as shown in FIG. 3, the support end portions 38 and 39 are arranged at one end and the other end of the long side of the gearbox 30, respectively. Vibration isolators 51 and 52 are interposed between the lower surfaces of the support end portions 38 and 39 and the upper surface of the base plate 7, respectively. That is, the two vibration isolators 51 and 52 are arranged spaced apart from each other in the direction of the long side of the gearbox 30 (the direction orthogonal to the shaft). The side of the gearbox 30 is supported by the minimum necessary vibration isolators 51 and 52, thereby making it possible to reduce the cost.

The gearbox 30 to which the motor 10 and the screw compressor main body 20 are connected and the gas cooler 40 are placed on the base plate 7 via the vibration isolators 51, 52, and 53. The gearbox 30 and the gas cooler 40 are supported at three points, namely, the vibration isolators 51, 52, and 53, so that the gearbox 30 and the gas cooler 40 can be stably freestanding when placed on the base plate 7 or when detached from the base plate 7 and placed in another position.

The vibration isolators 51, 52, and 53 have predetermined spring properties and hence have the function of attenuating vibration transmitted from the gearbox 30 and the gas cooler 40 to the base plate 7. Each of the vibration isolators 51, 52, and 53 is, for example, a vibration isolating rubber. The vibration isolators 51, 52, and 53 are preferably made of the same member, i.e., the same material with the same shape. By using the same member in the vibration isolators, the cost can be reduced.

In the above-mentioned embodiment, the gas cooler 40 is detachably attached as a separate body to the lower part of one side surface, on the side of the screw compressor main body 20, of the gearbox 30. Alternatively, in a modification, the gas cooler 40 may be detachably attached to a lower part of the other side surface, on the side of the motor 10, of the gearbox 30.

As can be seen from the above description, the screw compressor 1 according to the present invention comprises: the screw compressor main body 20; the motor 10 for driving the screw compressor main body 20; the gearbox 30 interposed between the screw compressor main body 20 and the motor 10 to transmit a driving force of the motor 10 to the screw compressor main body 20; and the gas cooler 40 positioned below either the screw compressor main body 20 or the motor 10 and attached as a separate body to a side surface of the gearbox 30.

With the above-mentioned configuration, the gas cooler 40 is positioned below either the screw compressor main body 20 or the motor 10 and attached as the separate body to the side surface of the gearbox 30, thereby making it possible to easily detach the gas cooler 40, though the screw compressor is compact. As the gearbox 30 separately provided from the gas cooler 40 is not regarded as a pressure vessel, the gearbox 30 can adopt the optimal structure and material required therefor, and the screw compressor 1 can be manufactured at low cost.

The present invention can have the following features in addition to the features mentioned above.

That is, the vibration isolators 51, 52, and 53 are disposed between the base plate 7 on which the gearbox 30 and the gas cooler 40 are placed and the respective support end portions 38, 39, and 49 of the gearbox 30 and the gas cooler 40, respectively. With this configuration, vibration transmitted from the gearbox 30 and the gas cooler 40 to the base plate 7 can be attenuated.

The gearbox 30 and the gas cooler 40 are placed on the base plate 7 via the two vibration isolators 51 and 52 supporting the gearbox 30 and the one vibration isolator 53 supporting the gas cooler 40. With this configuration, the gearbox 30 and the gas cooler 40 can be stably freestanding through three-point support.

The only one vibration isolator 53 disposed in the gas cooler 40 is arranged substantially at the center, in the direction orthogonal to each of shafts of the motor 10 and the screw compressor main body 20, of the gas cooler 40. With this configuration, the gas cooler 40 has improved flexibility in the configuration of the heat exchange portion therein, which facilitates the replacement work of the tube nest portion in the gas cooler 40.

Each of the vibration isolators 51 and 52 disposed in the gearbox 30 is arranged in a vicinity of each corresponding end, in the direction orthogonal to each of shafts of the motor 10 and the screw compressor main body 20, of the gearbox 30. With this configuration, the side of the gearbox 30 is supported by the minimum necessary vibration isolators 51 and 52, thereby making it possible to reduce the cost.

The invention claimed is:

1. A screw compressor comprising:

a screw compressor main body;

a motor for driving the screw compressor main body;

a gearbox having opposite side surfaces and a bottom, the gearbox being interposed between the screw compressor main body and the motor to transmit a driving force of the motor to the screw compressor main body; and a gas cooler having a cooler casing having a top and a side surface, the cooler casing being positioned below either the screw compressor main body or the motor and the cooler casing side surface being detachably attached to a one side surface of the opposite side surfaces of the gearbox, wherein the cooler casing top is connected to the screw compressor main body via piping so that the gas cooler cools compressed gas discharged from the screw compressor main body; and the cooler casing is spaced apart from the screw compressor main body, and a heat exchange portion of the gas cooler is provided in the cooler casing.

2. The screw compressor according to claim 1, wherein each of the gearbox and the gas cooler has a support end portion, and a vibration isolator is disposed between a base plate on which the gearbox and the gas cooler are placed and each of the support end portions of the gearbox and the gas cooler.

3. The screw compressor according to claim 1, wherein the gearbox has two support end portions and the gas cooler has a single support end portion, and a vibration isolator is disposed between a base plate on which the gearbox and the gas cooler are placed and each of the support end portions of the gearbox and the gas cooler.

4. The screw compressor according to claim 3, wherein the motor has a motor shaft extending in a direction, only one vibration isolator disposed between the base plate and the single support end portion of the gas cooler is arranged substantially at a center of the gas cooler in a direction orthogonal to the extending direction of the motor shaft.

5. The screw compressor according to claim 2, wherein the motor has a motor shaft extending in a direction, each of the vibration isolators disposed between the base plate and the support end portions of the gearbox is arranged in a vicinity of opposite ends of the gearbox in a direction orthogonal to the extending direction of the motor shaft.

6. The screw compressor according to claim 4, wherein each of the vibration isolators disposed between the base plate and the support end portions of the gearbox is arranged in a vicinity of opposite ends of the gearbox in a direction orthogonal to the extending direction of the motor shaft.

7. The screw compressor according to claim 3, wherein the motor has a motor shaft extending in a direction, only one vibration isolator disposed between the base plate and the single support end portion of the gas cooler is arranged substantially at a center of the gas cooler in a direction orthogonal to the extending direction of the motor shaft.

8. The screw compressor according to claim 3, wherein the motor has a motor shaft extending in a direction, each of the vibration isolators disposed between the base plate and the support end portions of the gearbox is arranged in a vicinity of opposite ends of the gearbox in a direction orthogonal to the extending direction of the motor shaft.

9. The screw compressor according to claim 7, wherein the motor has a motor shaft extending in a direction, each of the vibration isolators disposed between the base plate and the support end portions of the gearbox is arranged in a vicinity of opposite ends of the gearbox in a direction orthogonal to the extending direction of the motor shaft.

10. The screw compressor according to claim 1, wherein the gas cooler includes a first gas cooler and a second gas cooler wherein the cooler casing is formed in a substantially rectangular parallelepiped shape and the heat exchange portion includes a first heat exchanger in the first gas cooler and a second heat exchanger in the second gas cooler.

11. The screw compressor according to claim 1, wherein the gas cooler has a substantially rectangular parallelepiped shape having a long axis, a short axis, and a height wherein the gas cooler is mounted on a base plate in such an orientation that has the long axis orthogonal to an extending direction of a motor shaft of the motor, the short side axis extending along the extending direction of the motor shaft, and the height orthogonal to the extending direction of the motor shaft.

12. The screw compressor according to claim 1, wherein the side surface of the gas cooler is provided with a first attachment portion and the one side surface of the gearbox is provided with a second attachment portion, and the gas cooler is attached to the gearbox via connection between the first attachment portion and the second attachment portion.

* * * * *